US005861782A

United States Patent [19]

Saitoh

[11] Patent Number: 5,861,782

[45] **Date of Patent: *Jan. 19, 1999**

[54] NONRADIATIVE DIELECTRIC WAVEGUIDE AND METHOD OF PRODUCING THE SAME

[75] Inventor: Atsushi Saitoh, Nagaokakyo, Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 699,158

[22] Filed: Aug. 16, 1996

[30] Foreign Application Priority Data

Aug. 18, 1995 [JP] Japan ..... 7-210566

[51] Int. Cl.[6] ..... H01P 3/16

[52] U.S. Cl. ..... 333/239; 333/248; 333/254

[58] Field of Search ..... 333/239, 248, 333/250, 254

[56] References Cited

U.S. PATENT DOCUMENTS 4,463,330 7/1984 Yoneyama ..... 333/239

5,473,296 12/1995 Ishikawa et al. ..... 333/239

FOREIGN PATENT DOCUMENTS 4407251 9/1994 Germany .

3270401 12/1991 Japan .

403270401 A 12/1991 Japan ..... 333/239

*Primary Examiner*—Robert Pascal

*Assistant Examiner*—Barbara Summons

*Attorney, Agent, or Firm*—Ostrolenk, Faber, Gerb & Soffen, LLP

[57] ABSTRACT

A nonradiative dielectric line is provided which solves problems concerning the relative positioning of the parts, mass production, and variations in electrical characteristics of a dielectric strip, and which makes integral molding using injection molding technology possible. A height of a dielectric in the propagation area is made higher than the height in the non-propagation area, and a dielectric layer having a low dielectric constant is provided in the non-propagation area. Thus, the thickness of the dielectric layer in the non-propagation area can be increased.

22 Claims, 11 Drawing Sheets

NONRADIATIVE DIELECTRIC WAVEGUIDE AND METHOD OF PRODUCING THE SAME

BACKGROUND OF THE INVENTION

1. Field of the Invention

The present invention relates to a nonradiative dielectric waveguide suitable for use in a transmission line, in an integrated circuit implemented in millimeter wave band equipment.

2. Description of the Related Art

FIGS. 19(A), 19(B), 19(C) and 19(D) are sectional views illustrating the construction of four types of conventional nonradiative dielectric waveguides (NRD guides). FIG. 19(A) shows a normal-type nonradiative dielectric line in which a dielectric strip 100 is provided between conductive plates 101 and 102 which are placed in parallel to each other. FIG. 19(B) shows a grooved-type nonradiative dielectric line in which a groove is formed in each of the conductive plates 101 and 102, with the dielectric strip 100 being fitted into the groove. FIG. 19(C) shows an insulation-type nonradiative dielectric line in which the dielectric strip 100 is provided between conductive plates 105 and 106 via dielectric layers 103 and 104 having a low dielectric constant. FIG. 19(D) shows a winged-type nonradiative dielectric line in which dielectrics 107 and 108 are formed along the plane portion of conductive plates 109 and 110, each of the dielectrics 107 and 108 having a projecting winged portion, and the winged portions are made to contact each other.

In the waveguides, nonradiative dielectric waveguides have opposing conductive plates, and a dielectric strip inserted between the plates. Dielectric layers may also be provided on the surfaces of the conductive plates facing a path formed by the plates.

Electromagnetic wave having a polarization plane parallel to the surface of the conductive plates propagates in the dielectric strip, which is referred to as the "propagating region", while the propagation of such wave is cut-off in the other region, the "cut-off region", between the plates.

In such a nonradiative dielectric waveguide, transmission loss is reduced by making the spacing between the conductors less than a half of the wavelength of the propagating electromagnetic wave, thus suppressing the radiant wave in a bent portion or a non-continuous portion.

However, in the normal-type nonradiative dielectric line shown in FIG. 19(A), highly accurate positioning of dielectric strips to form an electromagnetic wave path is relatively difficult, and such structure is susceptible to vibrations and impact since no mechanism for positioning the dielectric is provided in the conductor planes.

The grooved-type nonradiative dielectric line shown in FIG. 19(B) excels in positioning and the mechanical strength of the wave guide. However, there are problems, for example, current flow concentrated in the corner portions of the groove causes large loss of transmission, and a conductive plate having grooves is disadvantageous in view of the cost of mass production. Furthermore, if a dielectric strip having a high dielectric constant, er, greater than about 5 is used, a small gap between the strip and conductive plate may cause unpredictable changes in the characteristics of the waveguide.

In the insulation-type nonradiative dielectric line of FIG. 19(C), since a dielectric layer of a low dielectric constant is provided between a dielectric strip of a high dielectric constant and a conductive plate, even if the nonradiative dielectric waveguide is reduced in size by using a dielectric material of a high dielectric constant, the problem of the narrowing of the signal operating region due to the occurrence of a high-order mode does not occur. Further, variations of characteristics due to the gap between the strip and the conductive plate are eliminated. However, the insulation-type nonradiative dielectric line has the same drawbacks as those of the normal-type nonradiative dielectric line in the positioning and the mechanical strength of the dielectric strip.

In the winged-type nonradiative dielectric line shown in FIG. 19(D), the above-described problems are eliminated. However, the higher the dielectric constant of the material used, or the higher the frequency used, the thinner the wing portion must be made. Thus, it becomes difficult to produce a dielectric layer having a small winged portion even if an injection molding technology is employed.

SUMMARY OF THE INVENTION

It is an object of the present invention to provide a nonradiative dielectric waveguide which solves the above problems and improves the positioning of the dielectric strips during the manufacturing process, reduces transmission loss, and avoids characteristic changes at a bend in the waveguide.

To achieve these objects, the present invention provides a nonradiative dielectric waveguide including an upper conductor; a lower conductor located apart from the upper conductor; main surfaces of the upper and lower conductors being opposite to each other; a first dielectric layer at a lower surface of the upper conductor; a second dielectric layer at an upper surface of the lower conductor; a bridging dielectric which connects respective parts of the first and second dielectric layers to form a propagating region; wherein a distance between the upper and lower conductors in the propagating region, at the bridging dielectric, is larger than the distance between the upper and lower conductors at other parts of the first and second dielectric layers in a non-propagating region.

In accordance with another aspect of the present invention, in the nonradiative dielectric waveguide, the upper and lower dielectric layer, and the bridging dielectric are integrally formed by molding.

In such a waveguide, since the distance between the conductors in the non-propagation area is made smaller than the distance between the conductors in the propagation area, and since a dielectric layer having a low dielectric constant is provided in the non-propagation area, it is possible to increase the thickness of the dielectric layer in the non-propagation area more than in the prior art winged-type nonradiative dielectric line. Therefore, even if the nonradiative dielectric waveguide is reduced in size by using a dielectric material of a relatively high dielectric constant, a dielectric layer and a bridging dielectric can be integrally formed by molding, such as by an injection molding method. Furthermore, since the propagation area and the non-propagation area are formed at the same time, various problems concerning the position determination, mass production, and characteristic variations of the dielectric strip as in the conventional waveguides do not occur.

In accordance with still another aspect of the present invention, the nonradiative dielectric waveguide may have a dielectric filling in a space formed by the first and second dielectric layers. The dielectric constant of the filling dielectric may be lower than that of the bridging dielectric.

Also, the present invention provides a nonradiative dielectric waveguide wherein the distance between the first and second conductors is changed smoothly in the area around the bridging dielectric, in order to avoid sharp corners in the conductors and the dielectrics.

Further, the present invention provides a nonradiative dielectric waveguide wherein the bridging dielectric is separable into at least upper and lower portions.

In such a waveguide, since the upper and lower members are combined after being formed separately, a conductor film may be easily formed on only one of the surfaces of each dielectric, and therefore the molding of the dielectric material becomes easy.

Still further, the present invention provides a nonradiative dielectric waveguide having a circuit board having a strip line which is operatively connected to the bridging dielectric. The circuit board is located between the upper and lower members of the bridging dielectric.

An integrated circuit or an active component can be formed easily in which the conductor circuit on the circuit board is coupled to the nonradiative dielectric waveguide.

Also, the present invention provides a nonradiative dielectric waveguide wherein at least one of the first and second dielectric layers has a structure with holes, such as a honeycomb structure, to reduce its effective dielectric constant.

Other features of the present invention will become apparent from the following descriptions of embodiments thereof.

DETAILED DESCRIPTION OF EMBODIMENTS OF THE INVENTION

First Embodiment

Figure 1:
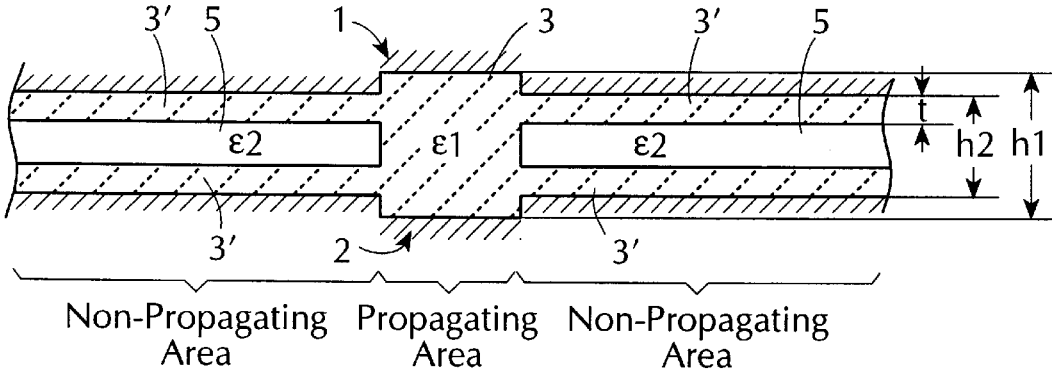
FIG. 1 is a sectional view illustrating a nonradiative dielectric waveguide according to a first aspect of the present invention.

Referring to FIG. 1, the distance h1 between the upper and lower two conductors 1 and 2 in a propagation area is made greater than the distance h2 between the upper and lower two conductors 1 and 2 in the non-propagation area. And the conductor portions in the non-propagation area are covered by a dielectric layer 3' which extends from a dielectric 3, which is referred to as the "bridging dielectric" or "dielectric strip", of the propagation area having a dielectric constant e1, and a dielectric layer 5 having a dielectric constant e2 which is lower than e1.

Here, the thickness t of the dielectric layer 3' is made thinner than corresponding portions of the dielectric strip 3. The relationship among h2, t and the cut-off frequency will be described later.

Figure 8:
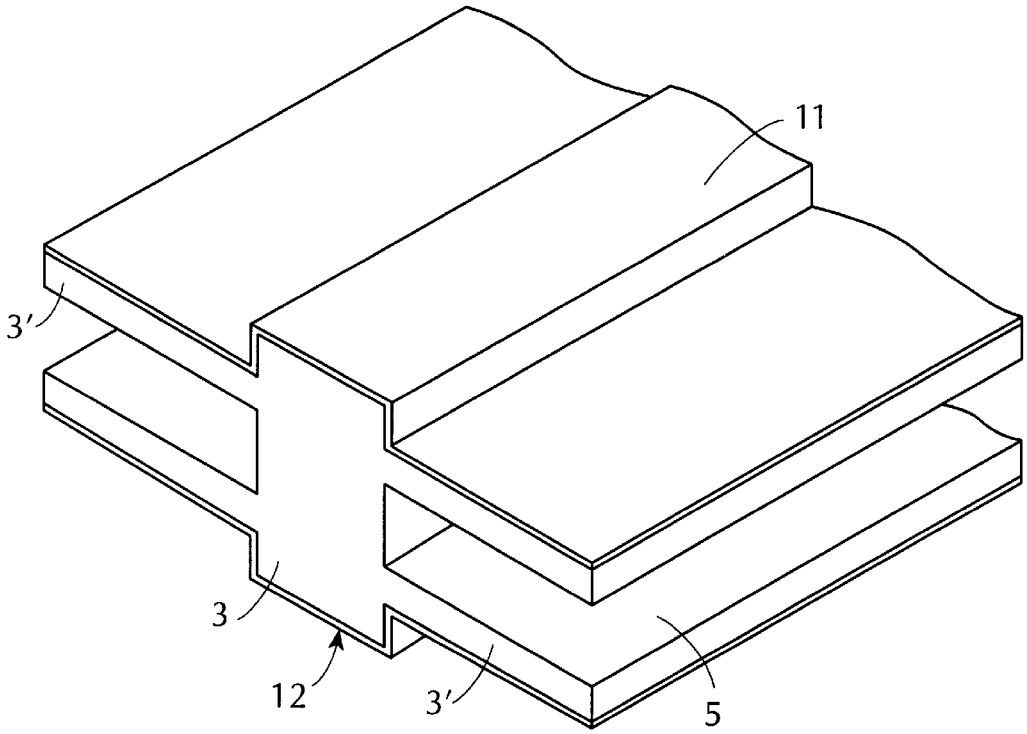
FIG. 8 is a partial perspective view of the nonradiative dielectric waveguide according to the first aspect of the present invention.

Referring to FIG. 8, the dielectric 3, the "bridging dielectric", and the dielectric layers 3' are integrally molded components of a dielectric ceramic or resin having a dielectric constant e1=7.3. Electrically conductive films 11 and 12 formed by coating and baking a silver paste, or by copper plating, are formed respectively on the top and bottom surfaces thereof. A dielectric layer 5 having a low dielectric constant in the non-propagation area is an air layer having a dielectric constant e2.

Figure 9:
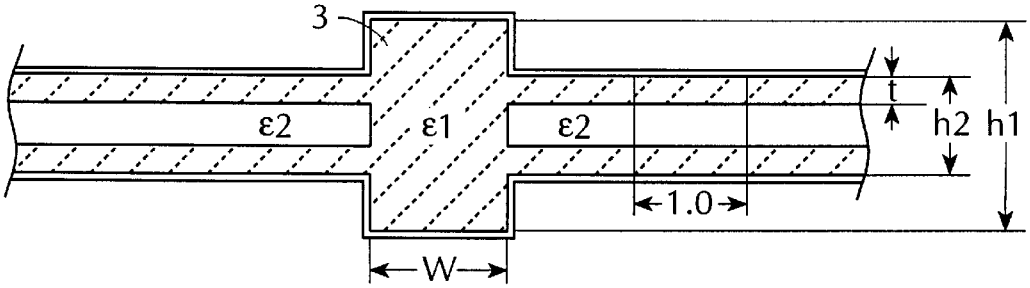
FIG. 9 is a sectional view of the nonradiative dielectric waveguide according to the first aspect of the present invention.
Figure 10:
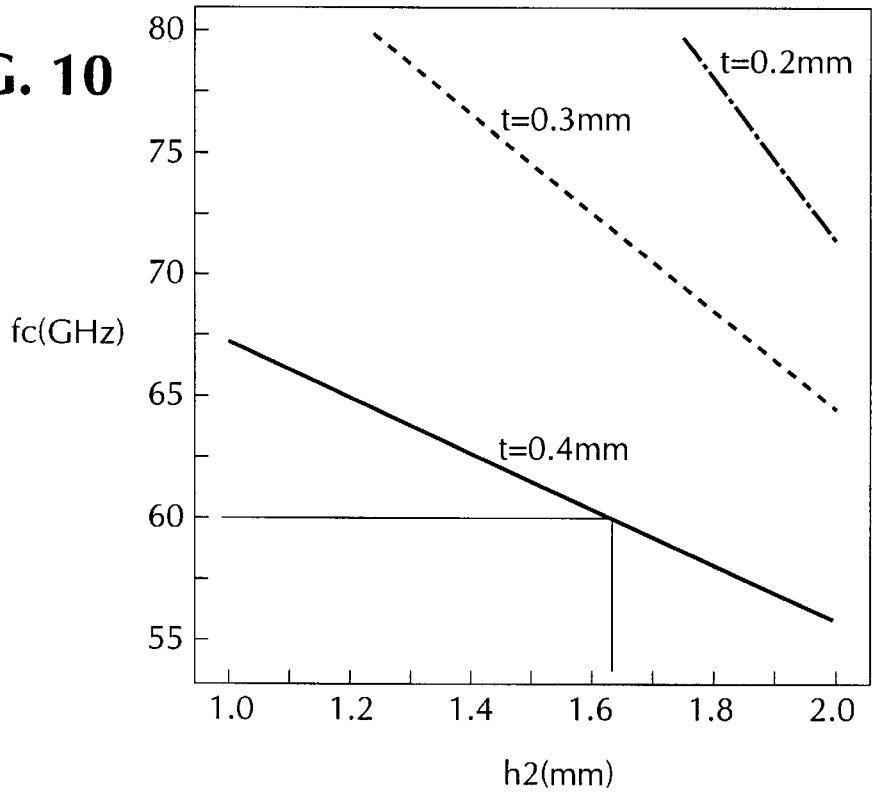
FIG. 10 shows the relationship between the height h2 and the cut-off frequency fc in the non-propagating area with the thickness t of the dielectric in the non-propagating area as a parameter.

FIG. 9 shows the dimensions of the parts shown in FIG. 8. When this nonradiative dielectric line is used as a transmission line in the 60 GHz band, the dimensions of the parts are set, for example, as follows: h1=2.0 mm, h2=1.2 mm, t=0.4 mm, and w=1.0 mm, wherein the dimensions h2 and t are set so as to cut off the electromagnetic wave of a frequency to be propagated in the propagation area. As shown in FIG. 9, in this example, a part (width: 1.0 mm) of the non-propagation area is used as a calculation model, and the relationship between the cut-off frequency and h2 is determined with t as a parameter, the results of which are shown in FIG. 10. That is, if t is constant, the smaller the h2, the higher the cut-off frequency becomes; if h2 is constant, the greater the t, the lower the cut-off frequency becomes. For example, if t=0.4 mm, to make the cut-off frequency to be above 60 GHz, h2 should be less than approximately 1.65 mm. Also, if, for example, h2=1.65 mm, to make the cut-off frequency to be 60 GHz, t should be 0.4 mm.

Figure 11A:
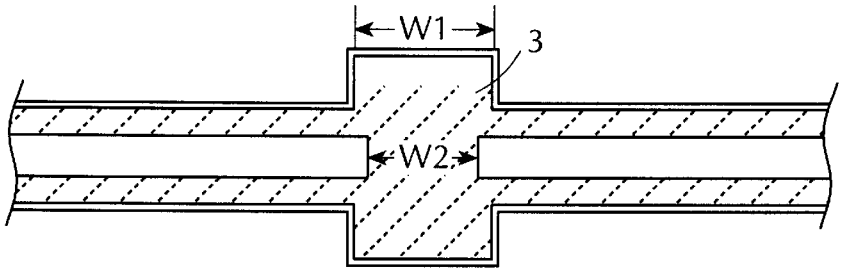
FIGS. 11(A) and 11(B) are sectional views of the construction of the nonradiative dielectric waveguide according to a modification of the first aspect of the present invention.
Figure 11B:
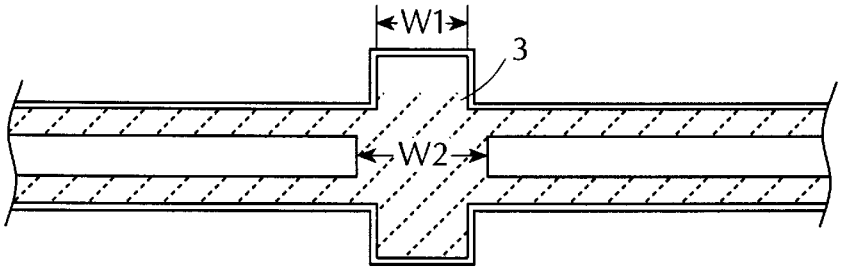

FIGS. 11(A) and 11(B) show the relationship between the width w1 of a part which protrudes vertically in the propagation area of the dielectric 3 and the width w2 of the intermediate portion. Although w1=w2 in the example shown in FIGS. 1, 8 and 9, it may be possible that w1>w2 as shown in FIG. 11(A), or w1<w2 as shown in FIG. 11(B).

Therefore, even if an attempt is made to make the nonradiative dielectric waveguide smaller in size on the whole by using a dielectric material of a relatively high dielectric constant, t will not become extremely small, and integral molding becomes possible by injection molding or the like. Furthermore, since the propagation area and the non-propagation area are formed at the same time, various problems of the prior art relating to positioning, mass production, and characteristic variations of the dielectric strip are solved at one time.

Second Embodiment

Figure 2:
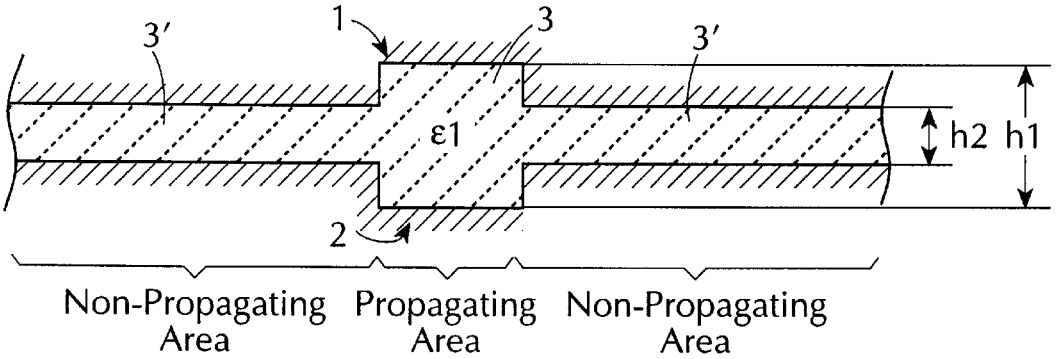
FIG. 2 is a sectional view of a nonradiative dielectric waveguide according to a second aspect of the present invention.
Figure 19A:
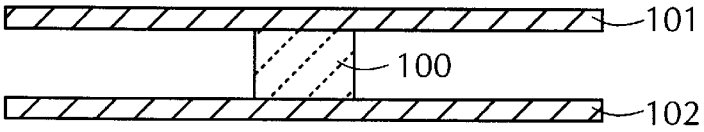
FIG. 19(A) Prior Art
FIGS. 19(A), 19(B), 19(C) and 19(D) are sectional views illustrating the construction of various conventional nonradiative dielectric waveguides.
Figure 19B:
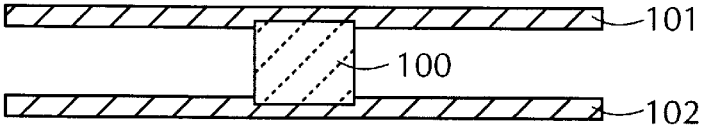
FIG. 19(B) Prior Art
Figure 19C:
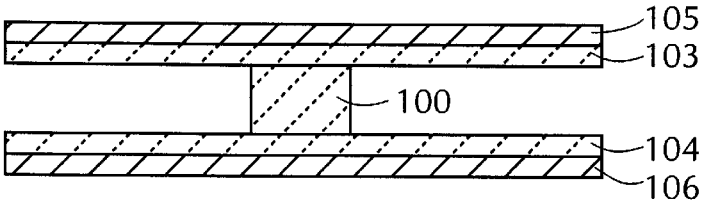
FIG. 19(C) Prior Art
Figure 19D:
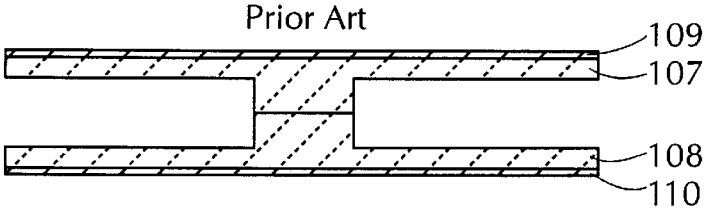
FIG. 19(D) Prior Art

Referring to FIG. 2, the distance h1 between the upper and lower two conductors 1 and 2 in the propagation area is made greater than the distance h2 between the upper and lower two conductors 1 and 2 in the non-propagation area, and the dielectric 3 and dielectric layers 3' are provided in substantially the entire space between these two conductors 1 and 2. Since in this manner the distance h2 between the conductors in the non-propagation area is made smaller than distance h1 between the conductors in the propagation area, due to the setting of e1, h1 and h2, an electromagnetic wave of a predetermined frequency band propagated in the propagation area, and in the non-propagation area the electromagnetic wave of that frequency band is cut off. Here, the thickness h2 of the dielectric layers 3' in the non-propagation area can be made greater than the sum of the thickness of the upper and lower two dielectric portions 107 and 108 in the non-propagation area of the winged-type nonradiative dielectric line shown in FIG. 19(D), since the distance between the upper and lower two conductors is lessened. Further, in comparison with FIG. 1, h2 of FIG. 2 becomes larger than t of FIG. 1, and integral molding by injection molding becomes easier. Further, since the propagation area and the non-propagation area are formed at the same time, various problems related to position determination, mass production, and characteristic variations of the dielectric strip as in the related art are solved at one time.

Figure 12:
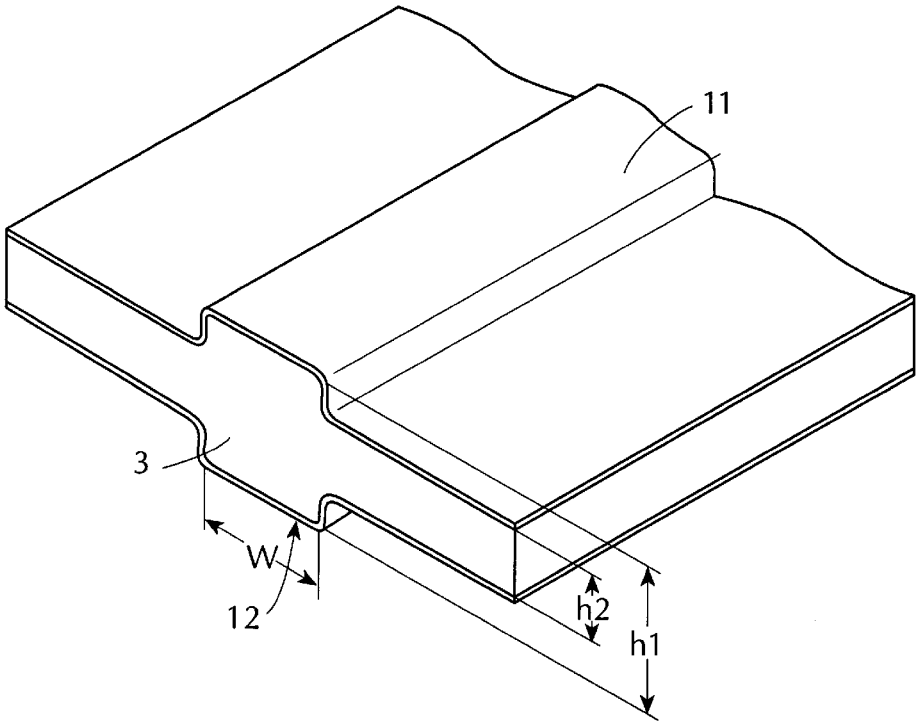
FIG. 12 is a partial perspective view of a nonradiative dielectric waveguide according to the second aspect of the present invention.

Referring to FIG. 12, reference numeral 3 denotes an integrally molded component formed from a dielectric ceramic or resin, with conductive films 11 and 12 being formed respectively on the entire top and bottom surfaces thereof. The height dimension h1 of the dielectric 3 which protrudes vertically in the propagation area is set so that an electromagnetic wave of a predetermined frequency band can be propagated in the propagation area, and the height h2 in the non-propagation area is set at a dimension at which an electromagnetic wave of the frequency band is cut off in such non-propagation area. When, for example, a dielectric ceramic having a relative dielectric constant of 7.3 is used, and is used as a transmission line in the 60 GHz band, h1=2.0 mm, h2=1.2 mm, and w=1.0 mm. The dielectric 3 may be made by machining without using injection molding. Further, the dielectric films 11 and 12 may be formed in such a way that the dielectric 3 is sandwiched by molded metallic plates without using plating or baking.

Third and Fourth Embodiments

Figure 3:
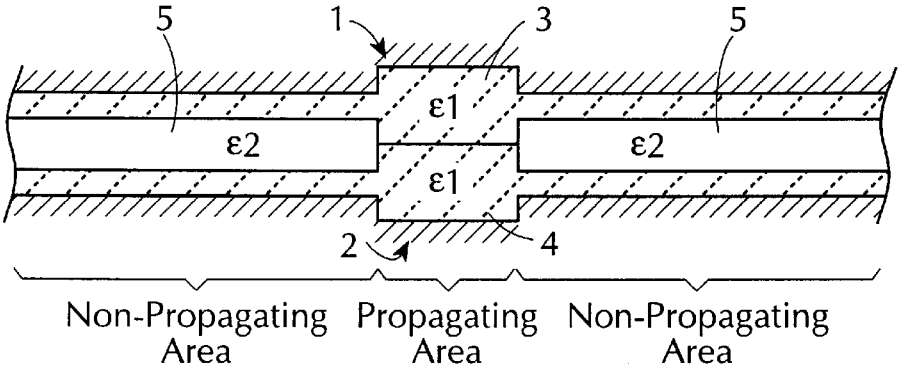
FIG. 3 is a sectional view of a nonradiative dielectric waveguide according to a third aspect of the present invention.
Figure 4:
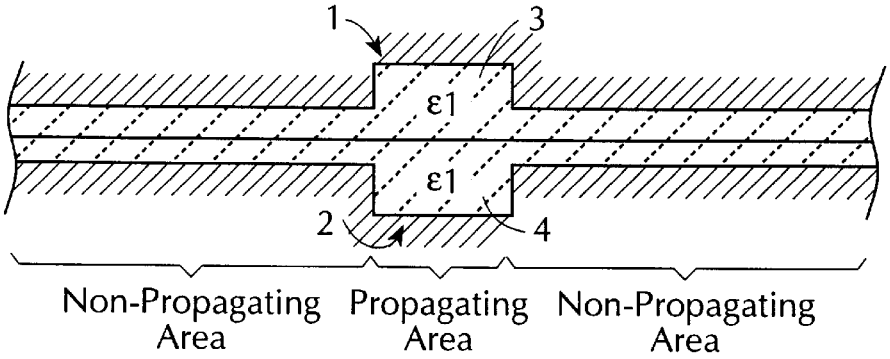
FIG. 4 is a sectional view of a nonradiative dielectric waveguide according to a fourth aspect of the present invention.

FIGS. 3 and 4 show further aspects of the nonradiative dielectric waveguide of the present invention, which are modifications of the first and second aspects, respectively, and which make molding easier and make it easy to form an integrated circuit together with a circuit board. According to these aspects, two members are combined, each of which is formed of a conductor and a dielectric and has a shape such that the dielectric portion is divided into two portions, i.e., upper and lower portions. Examples of the construction thereof are shown in FIGS. 3 and 4. In FIGS. 3 and 4, reference numerals 3 and 4 each denote dielectrics having a relative dielectric constant of e1. Reference numeral 5 denotes, for example, air having a relative dielectric constant of e2. The conductor 1 is formed by, for example, coating and baking a silver paste, or by plating with copper on the top surface of the dielectric 3, and the conductor 2 is formed on the bottom surface of the dielectric 4. In this nonradiative dielectric line, since respective upper and lower members are combined after being formed separately, the conductor film may be easily formed on only one surface of the dielectric. In particular, in the construction shown in FIG. 3, integral molding of the dielectric material also becomes easy.

Figure 13:
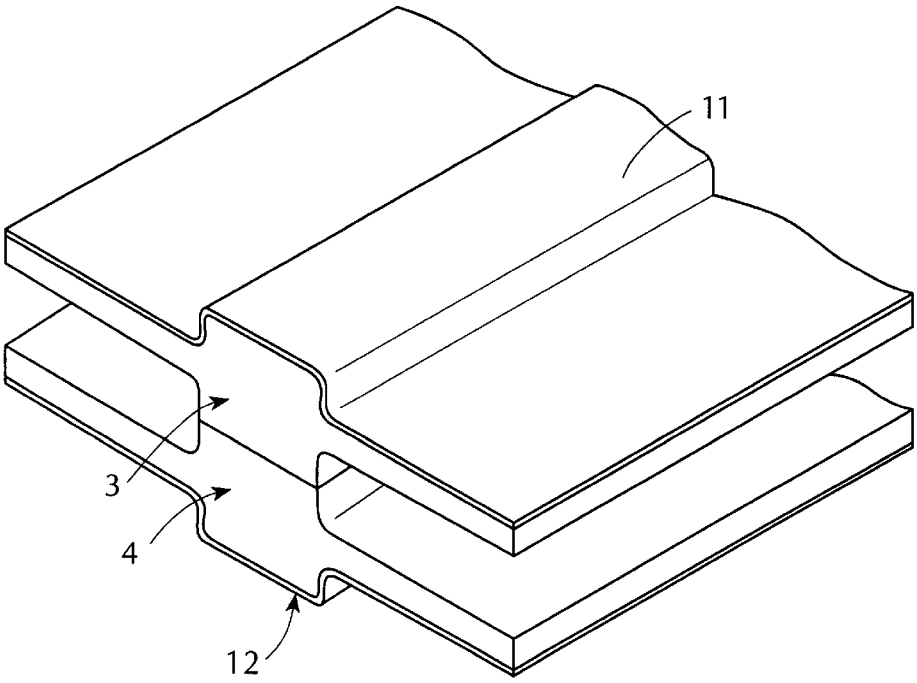
FIG. 13 is a partial perspective view of a nonradiative dielectric waveguide according to the third aspect of the present invention.
Figure 14A:
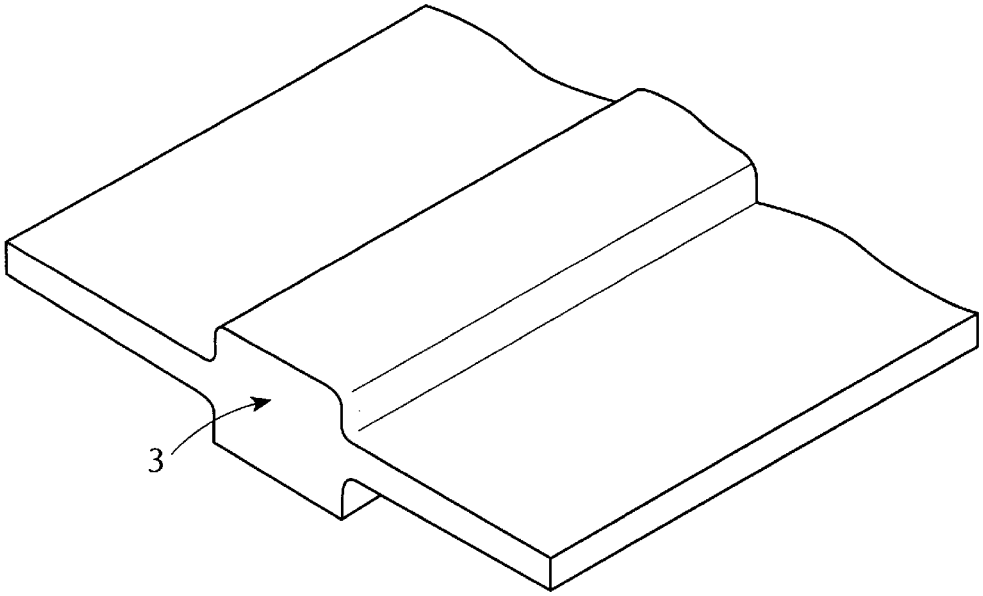
FIGS. 14(A) and 14(B) are partial perspective views illustrating an example of steps of manufacturing a nonradiative dielectric waveguide according to the third aspect of the present invention.
Figure 14B:
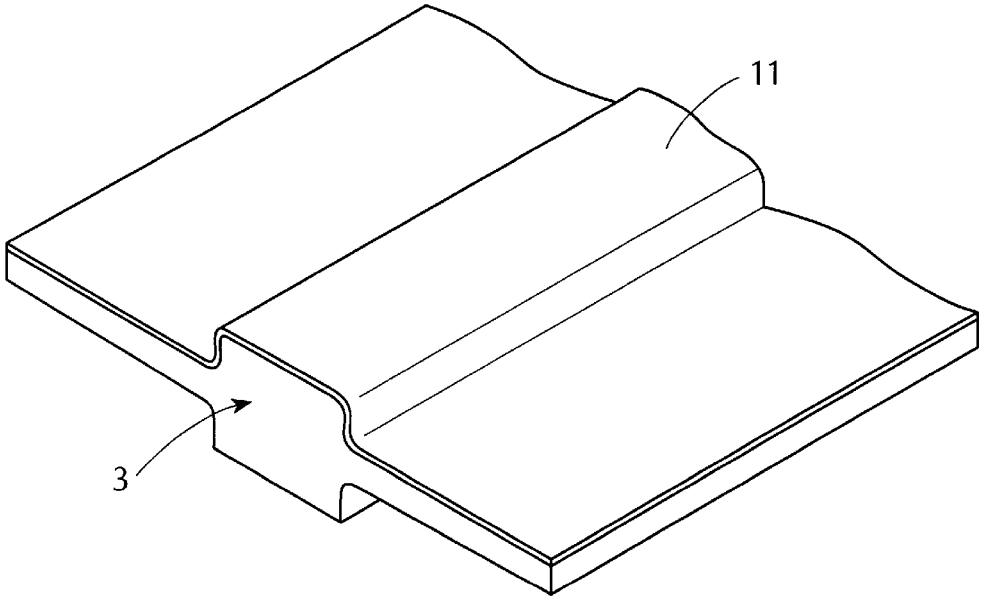

The third embodiment is further illustrated in FIGS. 13, 14(A) and 14(B). FIG. 13 is a perspective whole view. Reference numerals 3 and 4 each denote molded components of a dielectric ceramic or resin, with a conductor film 11 being formed on the top surface of the dielectric 3 and a conductor film 12 being formed on the bottom surface of the dielectric 4. FIGS. 14(A) and 14(B) show the procedures for making the nonradiative dielectric waveguide shown in FIG. 13. First, a dielectric of the shape shown in FIG. 14(A), which is referred to as the "waveguide body", is formed, and a conductor film 11 is formed by baking a silver electrode or by plating with copper on one surface of the dielectric as shown in FIG. 14(B). A pair of these waveguide bodies are arranged in a pattern of mirror symmetry, and are placed one on top of the other as shown in FIG. 13. A pair of these upper and lower members are enclosed in, for example, a case, and are held in the case with one on top of the other.

Figure 15:
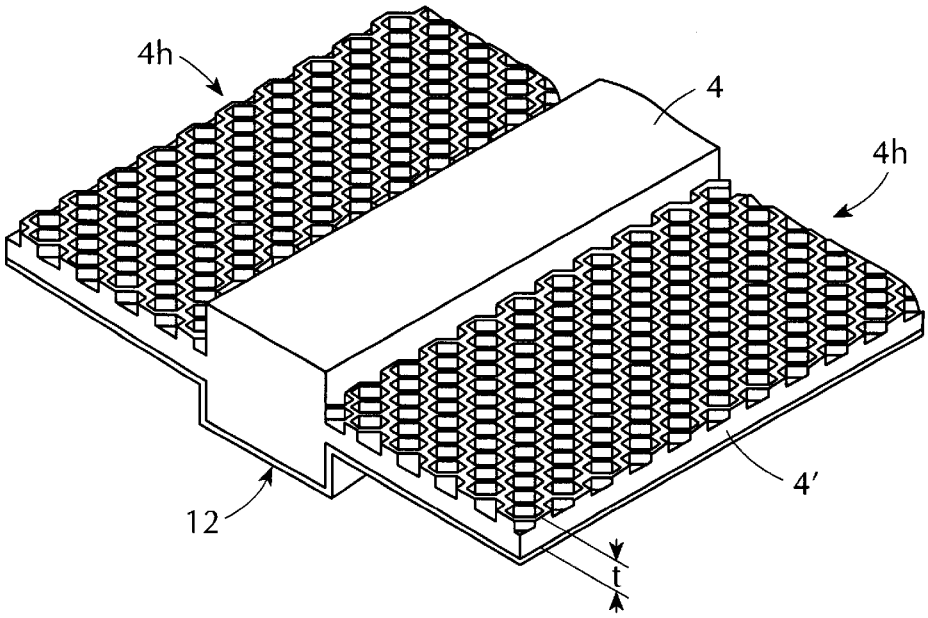
FIG. 15 is a partial perspective view of a nonradiative dielectric waveguide according to a modification of the third aspect of the present invention.

The lower and upper portions of the nonradiative waveguide shown in FIG. 13 may have honeycomb structures as indicated in FIG. 15. The top surface of the dielectric layer 4' in the non-propagation area is formed with a honeycomb structure 4h. Of course, the dielectric layer 4' may have another type of structure which also provides holes to reduce its effective dielectric constant. The dielectric 4 and dielectric layer 4' are integrally formed by molding a dielectric ceramic or a resin. A conductor film 12 is formed on the entire surface of both the propagation area and the non-propagation area on the back surface of the dielectric 4. Another member such as that shown in FIG. 15 is formed, and then the surfaces on which no conductor film is formed are made to face each other, whereby a nonradiative dielectric waveguide as shown in FIG. 13 is formed. In this case, since the effective dielectric constant of the honeycomb structure portion is low, it is possible to increase the thickness t of the dielectric layer 4' in the non-propagation area, making integral molding by injection molding easy, and increasing the strength of the dielectric layer.

Fifth and Sixth Embodiments

Figure 5:
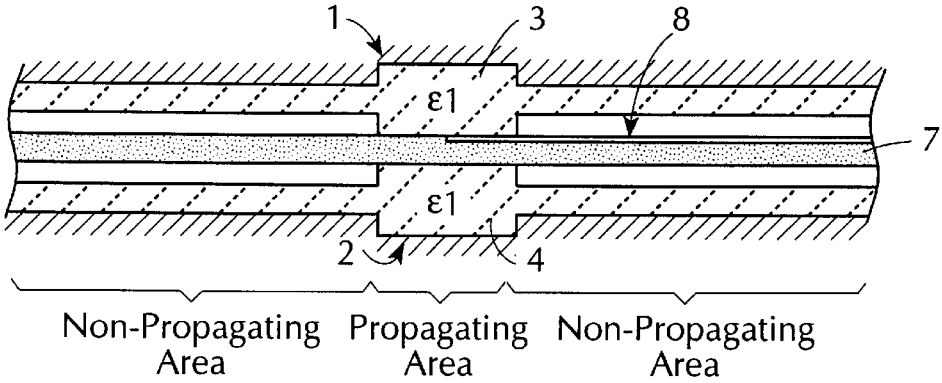
FIG. 5 is a sectional view of a nonradiative dielectric waveguide according to a fifth aspect of the present invention.
Figure 6:
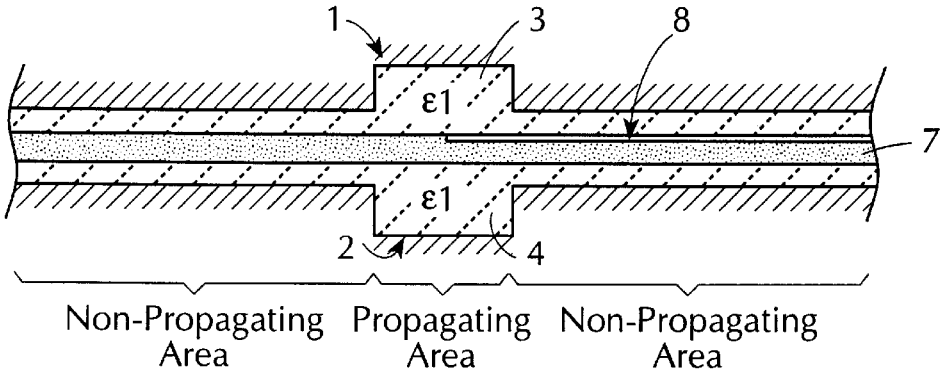
FIG. 6 is a sectional view of a nonradiative dielectric waveguide according to a sixth aspect of the present invention.
Figure 16:
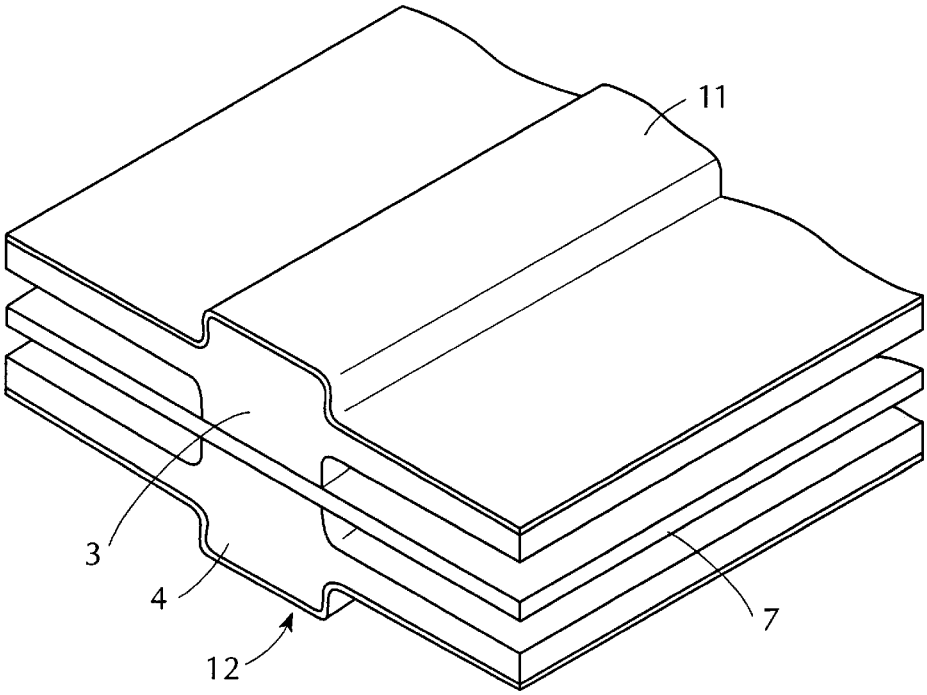
FIG. 16 is a partial perspective view of a nonradiative dielectric waveguide according to the fifth aspect of the present invention.

Referring to FIGS. 5, 6 and 16 reference numeral 7 denotes a circuit board having a strip line 8 formed in a part thereof. In FIGS. 5 and 16, a circuit board 7 is interposed between the upper and lower members in the nonradiative dielectric waveguide shown in FIG. 3. In FIG. 6, a circuit board 7 is interposed between the upper and lower members in the nonradiative dielectric waveguide shown in FIG. 4. In such a waveguide, the electromagnetic wave propagating in the propagation area is coupled to the strip line 8, and an integrated circuit or an active component is formed in which the conductor circuit on the circuit board 7 and the nonradiative dielectric waveguide are coupled to each other.

Figure 17A:
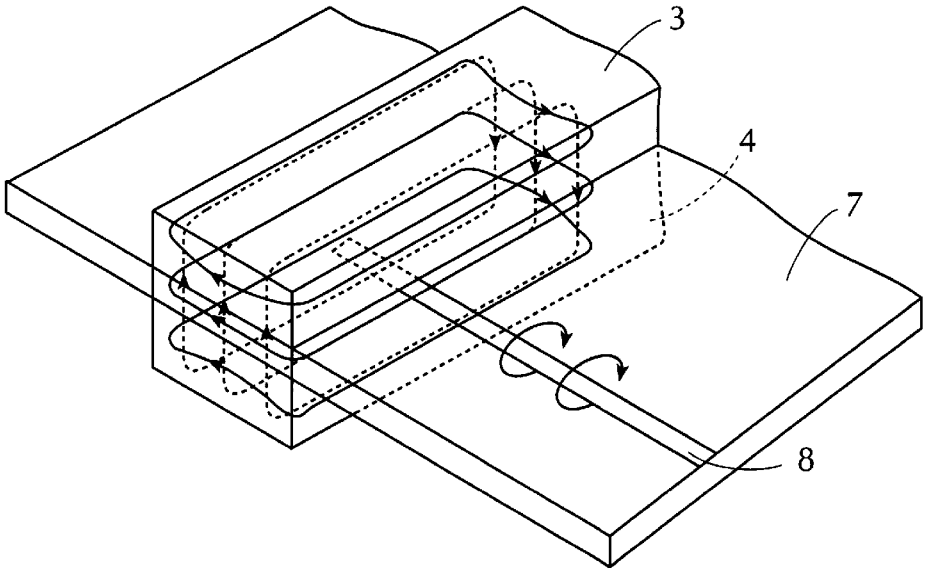
FIG. 17(A) illustrates the coupling between an electromagnetic wave of the $LSM_{01}$ mode propagating in the dielectric 3, and an electromagnetic wave of the TEM mode propagating in the strip line 8.
Figure 17B:
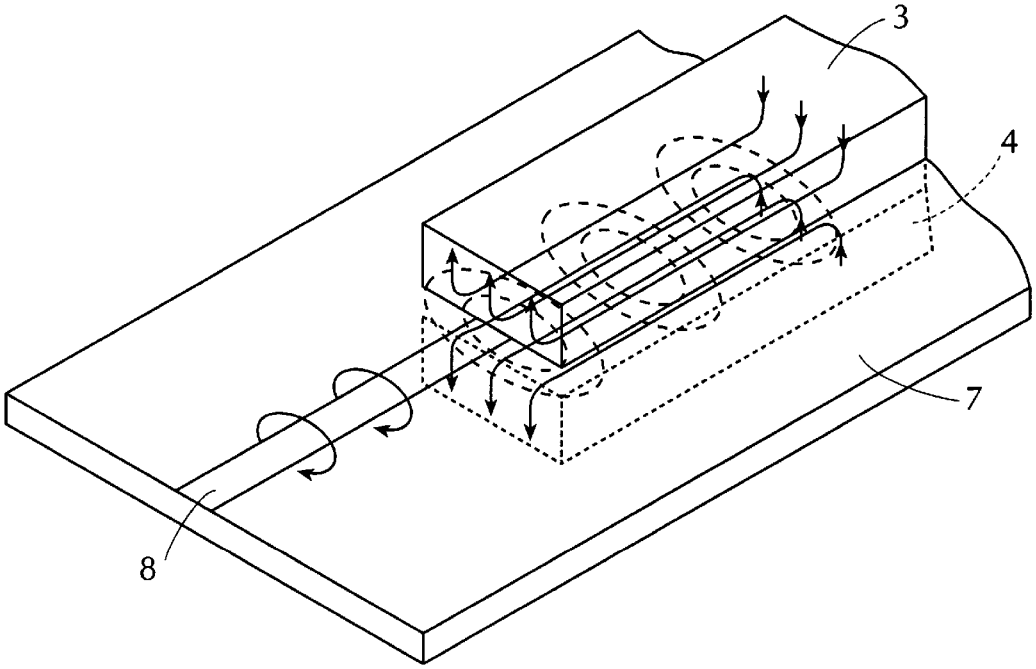
FIG. 17(B) illustrates the coupling between an electromagnetic wave of the $LSE_{01}$ mode propagating in the dielectric 3, and an electromagnetic wave of the TEM mode propagating in the strip line 8.

FIGS. 17(A) and 17(B) show the coupling relationship between the dielectric in the propagation area and the conductor on the circuit board. FIG. 17(A) shows the electromagnetic-field distribution in the LSM01 mode. FIG. 17(B) shows the electromagnetic-field distribution in the LSE01 mode. In these drawings, the dielectric layer and the conductor film in the non-propagation area of the dielectrics 3 and 4 are omitted. In FIGS. 17(A) and 17(B), the solid lines indicate the electric field, and the dashed lines indicate the magnetic field. When using the LSM mode, a strip line 8 is placed on the circuit board 7 in a direction at right angles to the electromagnetic-wave propagation direction of the nonradiative dielectric waveguide in order to electromagnetically couple the strip line 8 and the nonradiative dielectric waveguide to each other. Further, as shown in FIG. 17(B), when using the LSE mode, the strip line 8 is placed on the circuit board 7 along the electromagnetic-wave propagation direction of the nonradiative dielectric waveguide in order to couple such strip line 8 to the electromagnetic wave of the nonradiative dielectric waveguide. In this way, an integrated circuit or an active component for the millimetric wave band are formed.

Figure 18:
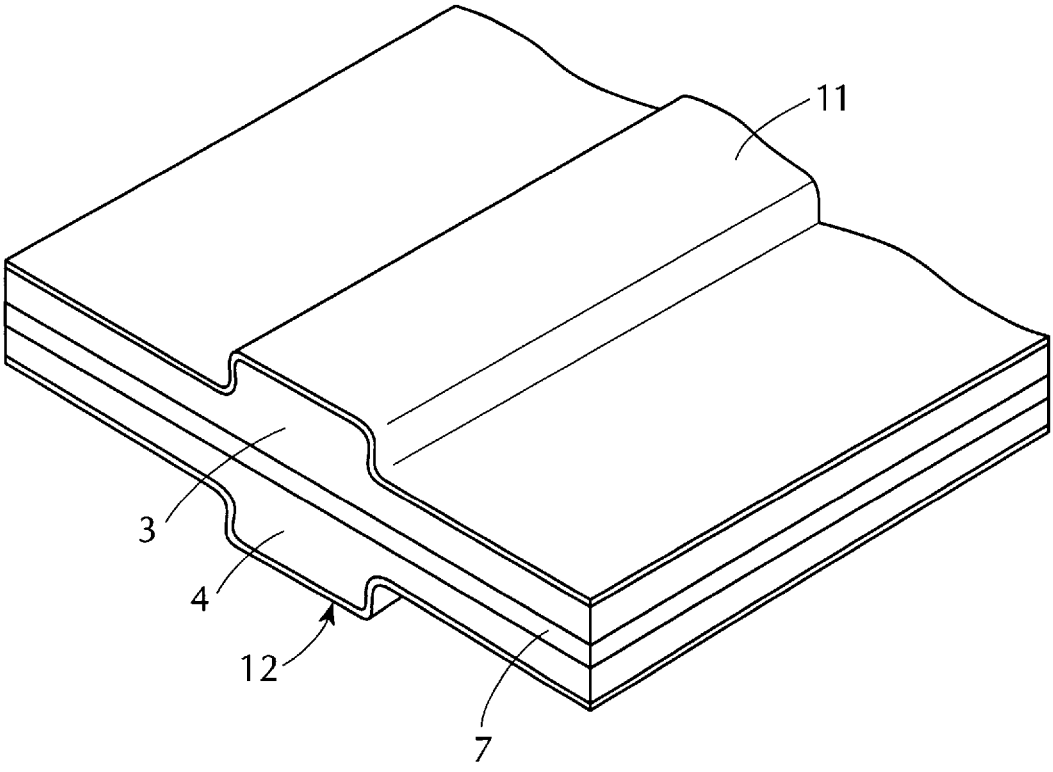
FIG. 18 is a partial perspective view of a nonradiative dielectric waveguide according to the sixth aspect of the present invention.

Referring to FIG. 18, in the dielectrics 3 and 4 in the sixth embodiment, the height of the non-propagation area is made lower than the height of the propagation area, a conductor film 11 is formed on the top surface in the figure of the dielectric 3, and a conductor film 12 is formed on the bottom surface in the figure of the dielectric 4. The circuit board 7 is interposed between these two dielectrics. A strip line such as that shown in FIG. 17(A) and 17(B) is provided on the circuit board 7, and this strip line is coupled to the electromagnetic wave which propagates through the nonradiative dielectric waveguide.

Seventh Embodiment

Figure 7A:
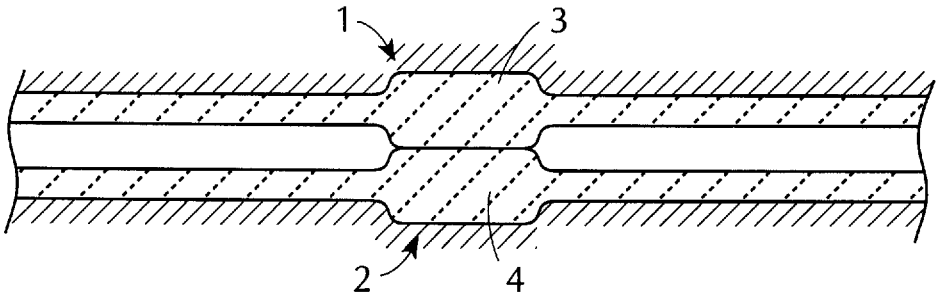
FIGS. 7(A) and 7(B) are sectional views of a nonradiative dielectric waveguide according to a modification of the third aspect of the present invention.
Figure 7B:
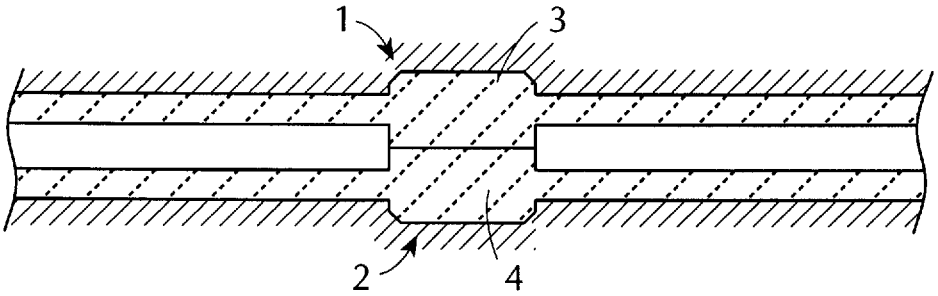

In FIGS. 7(A) and 7(B), the third embodiment has been modified such that all sharp corners in the dielectric or the conductor in the propagation area have been modified to have a curved shape. In FIG. 7(B), the sharp corners in the conductor and the dielectric in the propagation area have been modified to have a chamfered shape. Since the portion of the dielectric which forms the ridge of the dielectric projecting into the conductor in the propagation area is formed with chamfered or curved corners, the concentration of an electric current in that portion can be suppressed, and transmission loss can be reduced.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A nonradiative dielectric waveguide comprising:

an upper conductor;

a lower conductor located apart from said upper conductor;

a first dielectric layer disposed at a lower surface of said upper conductor; and at a second dielectric layer disposed at an upper surface of said lower conductor;

said first and second dielectric layers each having a respective bridging dielectric member which is thicker than other portions of the corresponding dielectric layers; said bridging dielectric member of said first dielectric layer having an inner portion which confronts a corresponding inner portion of the bridging dielectric member of said second dielectric layer to form a propagating region; and a distance between said upper and lower conductors adjacent said bridging dielectric members being larger than that in a non-propagating region adjacent other portions of said first and second dielectric layers.

2. A nonradiative dielectric waveguide according to claim 1, wherein said inner portions of said bridging dielectric members are narrower in width than other portions of said bridging dielectric members.

3. A nonradiative dielectric waveguide according to claim 1, wherein said inner portions of said bridging dielectric members are greater in width than other portions of said bridging dielectric members.

4. A nonradiative dielectric waveguide according to claim 1, wherein said first and second dielectric layers and said bridging dielectric members are comprised in an integral molded unit.

5. A nonradiative dielectric waveguide according to claim 1, wherein said first and second dielectric layers are separated from each other.

6. A nonradiative dielectric waveguide according to claim 5 further comprising:

a filling dielectric filled in a space defined between portions of said first and second dielectric layers away from said bridging dielectric members.

7. A nonradiative dielectric waveguide according to claim 6, wherein said filling dielectric consists essentially of air.

8. A nonradiative dielectric waveguide according to claim 6, wherein dielectric constant of said filling dielectric is lower than that of said bridging dielectric members.

9. A nonradiative dielectric waveguide according to claim 1, wherein said distance between the upper and lower conductors changes smoothly adjacent to the bridging dielectric members.

10. A nonradiative dielectric waveguide according to claim 9, wherein at least one said bridging dielectric member has curved surfaces adjacent to a corresponding one of said upper and lower conductors.

11. A nonradiative dielectric waveguide according to claim 9, wherein at least one said bridging dielectric member has chamfered surfaces adjacent to a corresponding one of said upper and lower conductors.

12. A nonradiative dielectric waveguide according to claim 1, wherein both of said bridging dielectric members are comprised in an integral molded unit.

13. A nonradiative dielectric waveguide according to claim 1, wherein said bridging dielectric members respectively form integral molded units with said first and second dielectric layers.

14. A nonradiative dielectric waveguide according to claim 1, wherein said first dielectric layer and said second dielectric layer contact each other.

15. A nonradiative dielectric waveguide according to claim 1 further comprising:

a circuit board having a strip line which is operatively connected to said bridging dielectric members, said circuit board being located between said bridging dielectric members.

16. A nonradiative dielectric waveguide according to claim 15, wherein at least one of said first dielectric layer and said second dielectric layer contacts said circuit board.

17. A nonradiative dielectric waveguide according to claim 1, wherein at least one of said first and second dielectric layers has at least one hole.

18. A nonradiative dielectric waveguide according to claim 17, wherein said at least one hole is comprised in a honeycomb structure.

19. A method of producing a nonradiative dielectric waveguide comprising the steps of:

forming a waveguide body having opposing dielectric plates and a dielectric strip therebetween, said plates having projections, on outer surfaces of said plates, adjacent said dielectric strip; and applying a conductive material on the outer surfaces of said plates.

20. A method according to claim 19, wherein said waveguide body is produced by molding.

21. A method of producing a nonradiative dielectric waveguide comprising the steps of:

forming a first waveguide body having a first dielectric plate and a dielectric strip attached to one surface of said first dielectric plate, said first plate having a first projection, on another surface of said first plate, adjacent said dielectric strip;

forming a second waveguide body having a second dielectric plate and a second projection which corresponds to said dielectric strip pattern;

opposing said first and second waveguide bodies so that said first and second projections face outward, and said dielectric strip is located between said first and second plates;

applying electrically conductive material on the outer surfaces of said plates.

22. A method according to claim 21, further comprising the step of:

placing a circuit board between said first and second waveguide bodies, said circuit board having a circuit pattern which is operatively connected to said dielectric strip.

* * * * *